US008471879B2

(12) United States Patent
Kanazawa et al.

(10) Patent No.: US 8,471,879 B2
(45) Date of Patent: Jun. 25, 2013

(54) IMAGE FORMING APPARATUS AND IMAGE FORMING METHOD

(75) Inventors: Ikuko Kanazawa, Hino (JP); Hirofumi Nakagawa, Takatsuki (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 13/213,266

(22) Filed: Aug. 19, 2011

(65) Prior Publication Data

US 2012/0188326 A1 Jul. 26, 2012

(30) Foreign Application Priority Data

Aug. 21, 2010 (JP) ..... 2010-185672
May 19, 2011 (JP) ..... 2011-111944

(51) Int. Cl.
*B41C 1/055* (2006.01)
*B41M 1/06* (2006.01)
*B41J 2/32* (2006.01)

(52) U.S. Cl.
USPC ..... 347/171

(58) Field of Classification Search
USPC ..... 347/171; 101/130
See application file for complete search history.

(56) References Cited

U.S. PATENT DOCUMENTS

2006/0065136 A1* 3/2006 Takahashi et al. ..... 101/3.1

FOREIGN PATENT DOCUMENTS

JP 10-016420 A 1/1998
JP 11-227351 A 8/1999

* cited by examiner

*Primary Examiner* — Huan Tran
(74) *Attorney, Agent, or Firm* — Canton Colburn LLP

(57) ABSTRACT

Disclosed is an image forming method including forming a concave-convex pattern on a surface of a plate by pressing the plate and a mold having the convex-concave pattern on a surface thereof against each other, the plate having the surface made of a material in which a hardness changes reversibly at a transition point temperature, forming a plate image constituted of a concave-convex region having the concave-convex pattern and a smooth region in which the concave-convex pattern is erased on the plate by erasing the concave-convex pattern by selectively heating the surface of the plate to the transfer point temperature or above corresponding to an image signal, and forming an image on a recording medium by forming an ink image on the plate by applying an ink on the plate image and by transferring the ink image on to the recording medium.

17 Claims, 10 Drawing Sheets

IMAGE FORMING APPARATUS AND IMAGE FORMING METHOD

BACKGROUND OF THE INVENTION

1. Field of the Invention

The present invention targets the field of offset printing suited for various kinds of small lot purposes.

2. Description of Related Art

Offset printing is a typical printing method where a plate in which hydrophilic portions and hydrophobic (lipophilic) portions corresponding to image information are formed is used to form an image on a recording medium by applying dampening water to the hydrophilic portions and selectively applying ink only to the hydrophobic portions and transferring the ink to the recording medium.

Offset printing method is a typical image forming method using a planographic printing plate. In the offset printing method, a planographic printing plate in which hydrophilic portions and hydrophobic (lipophilic) portions are formed on the surface corresponding to image information is made, and thereafter, an image is formed on a recording medium by applying dampening water W to the hydrophilic portions of the planographic printing plate, forming an ink image on the planographic printing plate by applying ink to the lipophilic portions and transferring the ink image on a recording medium. Such offset printing enables to continuously carry out image forming on a great number of recording media.

However, the planographic printing plate used for offset printing includes a hydrophobic photosensitive layer which is provided on a hydrophilic support formed of aluminum or the like and exposure process and etching process corresponding to image information are carried out to remove the photosensitive layer in non-image area. Therefore, complicated plate making process or waste disposal process needs to be carried out.

In view of the above, there is suggested a manufacturing method of a planographic printing plate (hereinafter, called a plate) in which the making process is easy (for example, see JP H10-16420 and JP H11-227351).

The technique described in JP H10-16420 is a technique to make a plate by recording the heat-melt transfer recording medium (ink ribbon) on a hydrophilic support including zinc oxide by a melt-transfer printer.

The technique described in JP H11-227351 is a technique to make a plate by forming a plate image on an original plate by an electrographic copier or printer by using sphere toner.

In both of the above techniques, the durable number of times of printing is decreased comparing to the offset printing. However, the process of making the plates is easy and wastes can be minimized.

However, by the techniques described in JP H10-16420 and JP H11-227351, the plate on which a plate image is once formed cannot be reused by forming a new image onto the plate, and a plate image needs to be formed by using a new plate even when one sheet or only a few images are to be printed. Therefore, these techniques are not suited for a so-called variable printing. Further, there is a problem that waste is increased because same plate cannot be used.

SUMMARY OF THE INVENTION

An object of the present invention is to provide an image forming apparatus and an image forming method by which a plurality of numbers of sheets can be printed continuously by using a plate in which plate images can be written repeatedly and which can be used for variable printing with small amount of waste.

To achieve at least one of the above objects, an image forming method reflecting one aspect of the present invention includes forming a concave-convex pattern on a surface of a plate by pressing the plate and a mold having the convex-concave pattern on a surface thereof against each other, the plate having the surface made of a material in which a hardness changes reversibly at a transition point temperature, forming a plate image constituted of a concave-convex region having the concave-convex pattern and a smooth region in which the concave-convex pattern is erased on the plate by erasing the concave-convex pattern by selectively heating the surface of the plate to the transfer point temperature or above corresponding to an image signal, and forming an image on a recording medium by forming an ink image on the plate by applying an ink on the plate image and by transferring the ink image on to the recording medium.

Preferably, the material is a resin which softens at the transition point temperature or above and hardens at below the transition point temperature.

Preferably, the material is hydrophobic or lipophilic and water is retainable by the concave-convex patter being forming on the surface.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of the present invention will be described. Here, the descriptions of the embodiments do not limit the technical scope of the present invention and definitions of the terms in any way.

Figure 1:
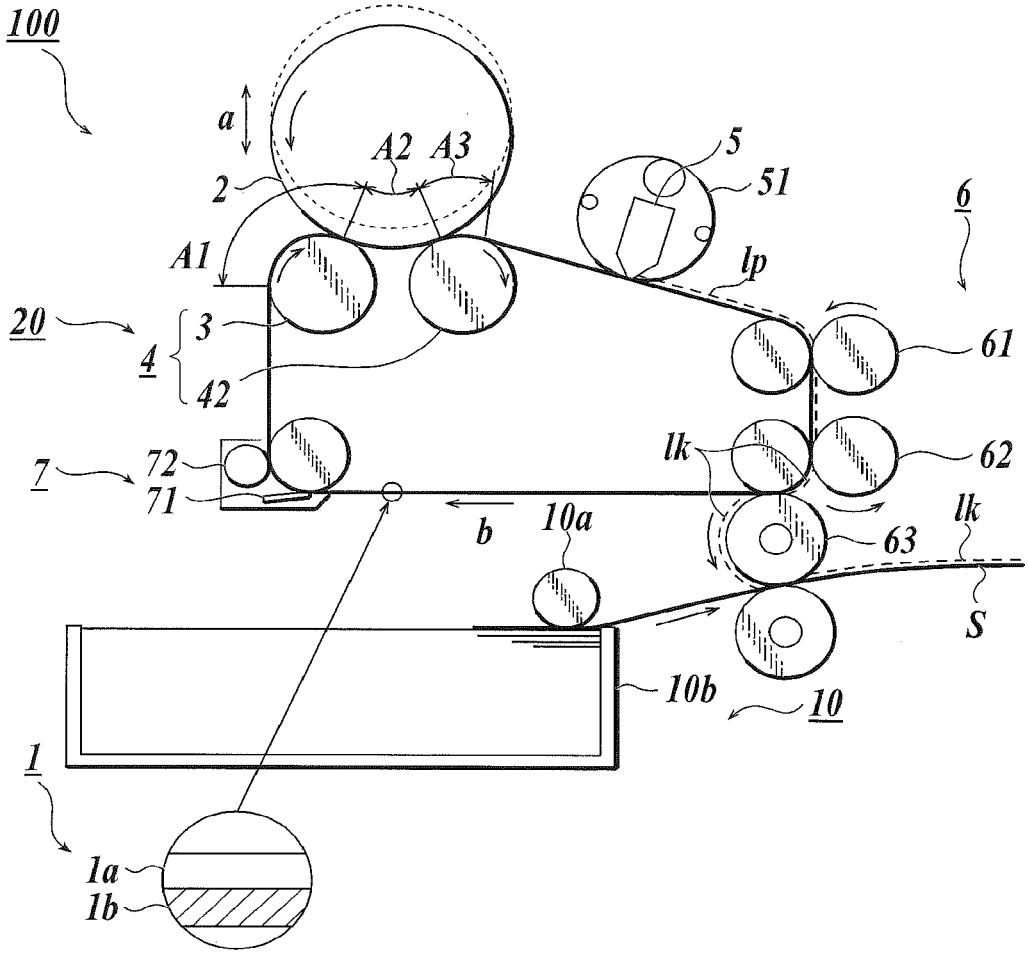
FIG. 1 is an outline cross structural view showing the first embodiment of an image forming apparatus 100 according to the present invention.

FIG. 1 is an outline cross sectional view showing the first embodiment of the image forming apparatus 100 according to the present invention.

The image forming apparatus 100 can form an image on a recording medium (for example, paper S) by forming an plate image Ip on a plate 1, forming an ink image Ik on the plate 1 by developing the plate image Ip with ink K and transferring the ink image Ik on the recording medium. Further, the image forming apparatus 100 allows new plate images Ip to be repeatedly formed on a plate, and this will be described in detail hereafter.

The belt-like plate 1 is to be constituted of a belt-like support 1*a* and a surface layer 1*b* formed on the support 1*a*.

The surface layer 1*b* is a resin which softens at transition point temperature Tm or above and which curs at a temperature below transition point temperature Tm, the transition temperature being original to the resin. On the other hand, the support 1*a* is made of a material having good heat resistance comparing to the surface layer 1*b* and the support 1*a* can maintain its function as a belt even in a state where the surface layer 1*b* is heated to the transition point temperature Tm or above. As for the support 1*a*, a metal belt (for example, a nickel electrocasting belt) or a resin in which the heat resistant temperature is greater than the transition point temperature Tm of the surface layer 1*b* (for example, a high-temperature resin such as a polyimid resin) is used.

As shown in the drawings, the plate 1 is stretched around five rollers including a heating roller 3 as a first hearing unit and a pressing roller 42 and is supported so as to rotate in the direction of the arrow b.

The concave-convex pattern forming unit 20 is for forming a concave-convex pattern on a surface of the plate 1 and includes the roller-like mold 2, the heating roller 3 and the first pressing unit 4.

The mold 2 is an aluminum-made roller in which a fine concave-convex pattern is formed on the surface thereof and is supported so as to be displaced as showing in the arrow a with respect to the plate 1. The solid line shows a state where the mold 2 is pressed against the plate 1 by the displacement mechanism (not shown in the drawing) and the dashed line shows a state where the mold 2 is separated from the plate 1.

The heating roller 3 is an aluminum-made roller in which a heater is built in and the surface thereof is covered with a silicon rubber. The heating roller 3 is heated to a predetermined temperature which exceeds the transition point temperature Tm by a heater starter control (not shown in the drawing) and the heating roller 3 contacts the plate 1 at the first region indicated by A1 as shown in the drawing. The surface layer 1*b* of the plate 1 is softened by being heated to the transition point temperature Tm or above by heat transferring from the first region A1. Here, heating is carried out by heat transfer. However, heating is not limited to this and heating can be carried out by emitting radiation energy to the plate 1 from outside as in a halogen heater or the like.

The first pressing unit 4 is to press the surface of the plate 1 which is heater to the transition point temperature Tm or above by the heating roller 3 against the surface of the mold 2. The first pressing unit 4 is constituted of a heating roller 3 which also functions as the first heating unit, the pressing roller 42 and the like.

The pressing roller 42 is disposed on the downstream side of the rotating direction of the plate 1 with respect to the heating roller 3. When the pressing roller 42 is in the state of pressing against the mold 2, the pressing roller 42 forms the second region A2 which occupies a wide rage in the rotating direction of the plate 1 in cooperation with the heating roller 3 as shown in the drawing. The pressing roller 42 is pressed against the mold 2 with a predetermined pressure via the plate 1 by a biasing unit (not shown in the drawing).

While the plate 1 which is heated to the temperature of transition point temperature Tm or above by the heating roller 3 passes through the second region A2, the first pressing unit 4 is hardened by lowering the temperature of at least the surface of the plate 1 to below the transition point temperature Tm by heat transferring to the mold 2. Further, at the extreme upstream end of the second region A2 where the heating roller 3 and the mold 2 are pressed against each other, the surface of the mold 2 is pressed against the surface of the plate 1 with a great pressure and the surface layer 1*b* of the plate 1 is deformed copying the concave-convex pattern of the mold 2.

As described above, the concave-convex pattern forming unit 20 makes the surface layer 1*b* of the plate 1 be soft by the heating roller (the first heating unit) 3 and makes the surface of the plate 1 be deformed copying the concave-convex pattern of the mold 2 by the first pressing unit 4 so that the concave-convex pattern of the mold 2 can be printed onto the surface of the plate 1 continuously and stably.

Here, the driving speed of the plate 1 is set to 300 mm/sec. However, in a case where the driving speed is increased, a stable forming of the concave-convex pattern can be carried out when the temperature set for the heating roller 3 is increased, for example. Further, in order to realize even more stable forming of the concave-convex pattern, a heating unit may be provided just before the heating roller 3.

Next, the thermal head 5 as a plate image forming unit is disposed on the downstream side of the pressing roller 42, and the thermal head 5 contacts the surface of the plate 1 which rotates. The thermal head 5 includes a plurality of heater elements (not shown in the drawing) which are arranged along the width direction of the plate 1 orthogonal to the rotating direction of the plate 1. Each of the heater elements is turned on or not turned on according to an image signal, and the heater elements selectively heat and soften the surface of the plate 1 to selectively erase the concave-convex pattern formed by the concave-convex pattern forming unit 20.

That is, when the plate 1 passes the contacting position of the thermal head 5, the parts of the plate 1 where contact the heater elements which are tuned on based on an image signal are softened by at least the temperature of the surface thereof increasing to the transition point temperature Tm or above and the concave-convex pattern is erased. On the other hand, the parts of the plate 1 where contact the heater elements which are not turned on based on the image signal are not heated and maintained at a temperature below the transition point temperature Tm and the concave-convex pattern is maintained.

Further, as shown in FIG. 1, it is preferred that the thermal head 5 is disposed so as to contact the surface of the plate 1 via a heat resistance film 51. The heat resistance film 51 is formed in a belt-like shape which extends in the width direction of the plate 1 orthogonal to the rotating direction of the plate 1 and the thermal head 5 is disposed inside thereof. The heat resistance film 51 is structured so as to rotate at the same speed as the driving speed of the plate 1. As for the heat resistance film 51, P1 (polyimide) film is suggested, for example. However, the heat resistance film 51 is not limited to this and may be an aluminum foil or the like as long as it is heat resistance.

Further, it is preferred that the thickness of the heat resistance film 51 is 25 μm or less, and thereby, the plate 1 can be heated by the thermal head 51 effectively. Here, when the thickness of the head resistance film 51 is greater than 25 μm, the plate 1 cannot be effectively heated by the thermal head 5 and there is a possibility that the concave-convex pattern formed by the concave-convex pattern forming unit 20 cannot be erased.

Here, the heat resistance film 51 is formed in a belt-like shape. However, the shape is not limited to this and the structure may be that the heat resistance film is provided so as to cover the surface of the plate 1 and the heat resistance film is peeled off from the surface of the plate 1 after being heated by the thermal head 5.

By the thermal head 5, a plate image Ip which is constituted of concave-convex regions Ar having the concave-convex pattern and smooth regions Af where the concave-convex pattern is erased according to an image signal is formed on the surface of the plate 1.

Further, by the thermal head 5 contacting the plate 1 via the heat resistance film 51 which rotates at the same speed as the plate 1, the smooth regions Af can be formed by selectively heating the image portions of the plate 1 without damaging the concave-convex pattern of the non-image portions (the concave-convex regions Ar) of the plate 1. Therefore, the smooth regions Af can be formed on the plate 1 with good accuracy and the quality of the image to be formed on the paper S by the image forming apparatus 100 can be improved.

Here, the thermal head 5 is used as the plate image forming unit. However, the smooth regions where the concave-convex pattern is erased can be formed by using a laser emitting unit which scans laser beam which is emitted by being modulated according to an image signal in the direction orthogonal to the rotating direction of the plate 1 to selectively heat the surface of the plate 1 and to apply a predetermined pressure to the surface of the plate 1.

Moreover, in order to achieve an extreme fine level of the plate image Ip, it is preferred that the temperature of the head portion of the thermal head 5 is set to the temperature close to the transition point temperature Tm of the surface layer 1*b* all the time and that the temperature of the surface of the plate 1 can be increased to the transition point temperature Tm by momentarily applying heat energy from the heating unit. Further, a semiconductor laser can be used to carry out a momentary noncontact local heating.

A cooling unit for cooling the plate 1 including the plate image Ip may be provided on the downstream side of the thermal head 5.

Here, a hydrophobic (lipophilic) resin in which pure water contact angle is 90° is used as a material for the surface layer 1*b* of the plate 1, and the surface characteristic is changed so that water can be retained easily by providing concaves and convexes on the surface by the concave-convex pattern forming unit 20. That is, water is retained in the concave-convex regions Ar and the smooth regions Af are hydrophobic. Therefore, the thermal head 5 forms a plate image Ip constituted of regions where water is easily retained and hydrophobic regions on the plate 1.

The print unit 6 is disposed on the downstream side in the rotating direction of the plate 1 with respect to the thermal head 5, and the printer unit 6 includes a dampening water supply roller 61 as a dampening water supply unit, an ink supply roller as an ink supply unit and a blanket roller 63.

The dampening water supply roller 61 is disposed on the upper side in the rotating direction of the plate 1 and contacts the plate 1 and selectively applies dampening water W to the concave-convex regions of the plate 1 by rotating as the arrow shown in the drawing.

The ink supply roller 62 is disposed on the downstream side of the dampening water supply roller 61 and contacts the plate 1 and forms an ink image Ik on the plate 1 by selectively applying ink K on the smooth regions of the plate 1 by rotating as the arrow shown in the drawing at the same speed as the plate 1.

The blanket roller 63 is disposed on the downstream side of the ink supply roller 62 and contacts the plate 1. Further, the blanket roller 63 transfers the ink image Ik on the plate 1 on to the blanket roller 63 itself at the primary transfer position and re-transfers the transferred ink image Ik on to the paper S at the secondary transfer position by rotating in the direction of the arrow shown in the drawing at the same line speed as the plate 1.

The cleaning device 7 is constituted of a cleaning blade 71 and a cleaning roller 72 and is disposed on the downstream side of the print unit 6. The cleaning device 7 removes the residual ink image Ik and dampening water W.

The paper feeding unit 10 includes a paper feeding tray 10*b* which houses a great number of papers S and a paper feeding roller 10*a* which conveys the papers S in the paper feeding tray 10*b* one by one. The paper feeding roller 10*a* operates in timely manner to convey the paper S to the secondary transfer position of the print unit 6.

Figure 2:
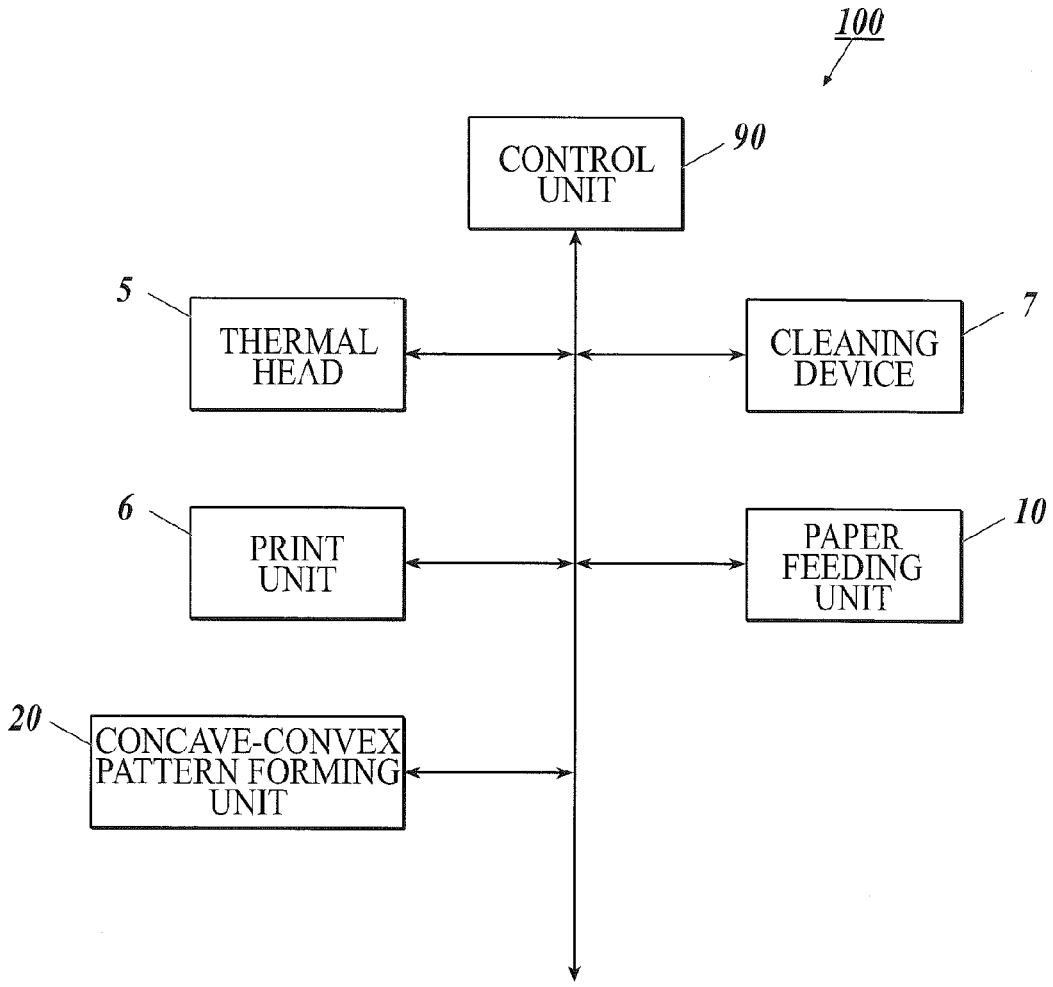
FIG. 2 is a block diagram showing a control system of the image forming apparatus 100.

As shown in FIG. 2, the control unit 90 controls each part of the image forming apparatus 100. The control unit 90 includes CPU (Central Processing Unit), RAM (Random Access Memory) and ROM (Read Only Memory) which are not shown in the drawing, and the control unit 90 carries out various types of operations in accordance with various types of processing programs for the image forming apparatus 100.

In particular, the control unit 90 controls the temperature for selectively heating the heater elements of the thermal head 5 based on an image signal, for example, and forms the smooth regions by erasing the concave-convex pattern in the regions corresponding to the non-image portions on the surface of the plate 1.

When the same image is to be repeatedly formed on a plurality of papers S by using the plate image Ip formed on the plate 1, the image forming apparatus 100 separates the cleaning device 7, the mold 2 and the thermal head 5 from the plate 1 by the displacement mechanism after forming the print image Ip and continuously prints the same image on the papers S by repeatedly operating the print unit 6 by continuing the orbit of the plate 1.

On the other hand, when forming a first image on the paper S or forming a different image for each paper S, the ink K and dampening water W of the plate 1 is cleaned by the cleaning device 7 on the downstream side of the print unit 6 and a fine convex-concave pattern is to be formed again on the surface of the plate 1 by the plate 1 going through the concave-convex pattern forming unit 20.

As described above, the image forming apparatus 100 of the first embodiment according to the present invention can form a new plate image Ip on the plate 1 by erasing the old plate image Ip and can form an image of the paper S by using the plate 1 on which the new plate image Ip is formed. Therefore, the image forming apparatus 100 of the first embodiment according to the present invention is excellent in high-speed performance by which images can be processed on a plurality of papers stably and continuously and can be used for variable printing.

The image forming method of the present invention which is carried out in the image forming apparatus 100 includes three procedures (the first, second and third procedures) which will be described below based on FIGS. 3, 4 and 5, and the procedures are carried out cyclically.

First, the first procedure by which a concave-convex pattern is formed on the surface the plate 1, the plate 1 being a plate having a material in which the hardness thereof reversibly changes when the temperature reaches the transition point temperature Tm, will be described.

Figure 3A:
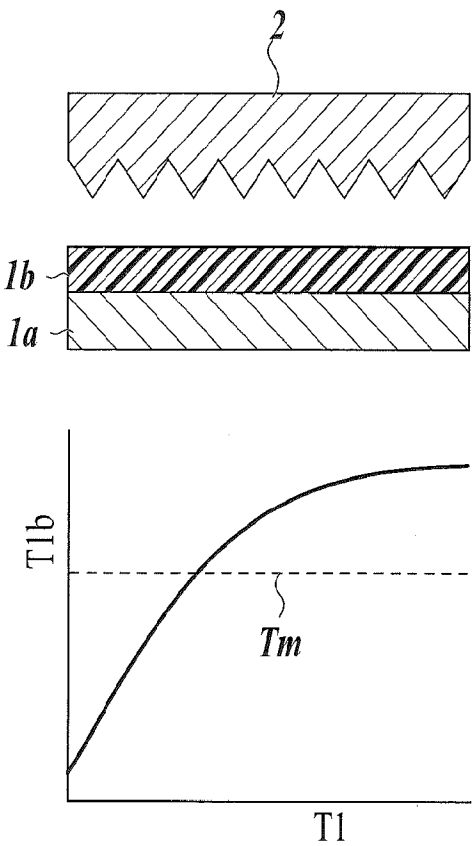
FIGS. 3A to 3C are schematic views showing a process of forming a concave-convex pattern on the surface of the plate 1 according to the present invention.
Figure 3B:
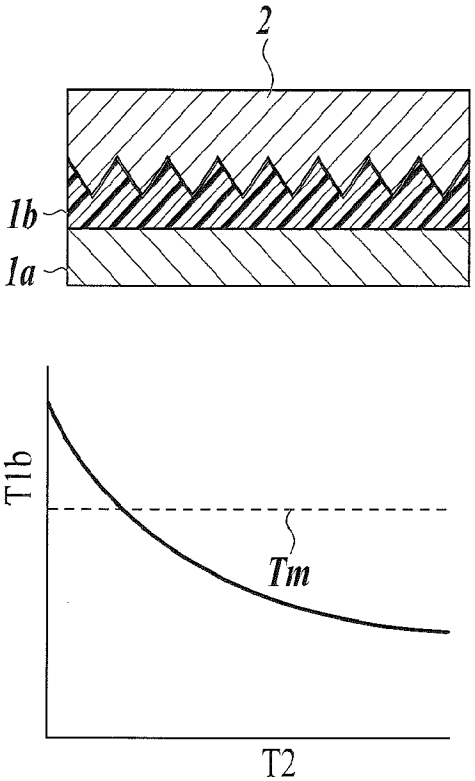
Figure 3C:
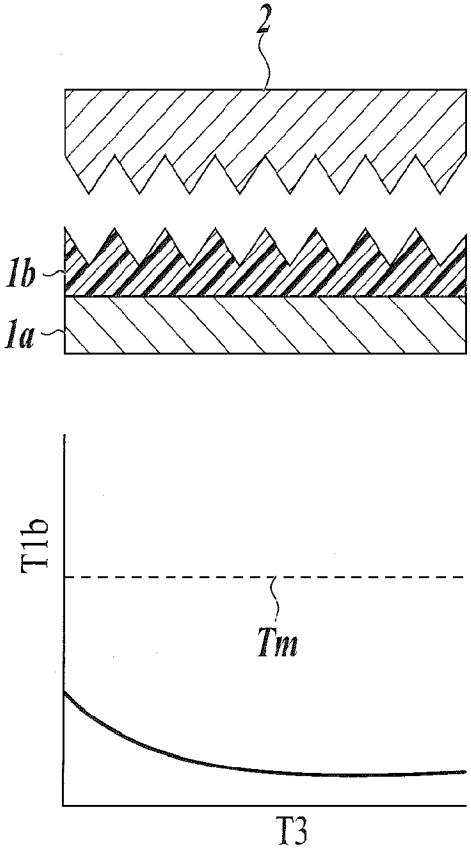

FIGS. 3A to 3C are schematic diagrams showing the first procedure by which a concave-convex pattern is to be formed on the surface of the plate 1 according to the present invention. The actual size of the concave-convex pattern is between μm order to nm order. Here, enlarged diagrams are shown.

FIG. 3A shows a state where the plate 1 is separated from the mold 2 as a mold having a convex-concave pattern and is heated by heat transfer from the heating roller 3 as the first heating unit. The lower graph shows the relation between the elapsed time T1 during which the plate 1 is heated by contacting the heater roller 3 and the surface temperature T1*b* of the plate 1. Tm indicates the softening temperature (transition point temperature) of the surface layer 1*b* in which the hardness thereof reversibly changes according to temperature.

The surface temperature T1*b* of the plate 1 increases according to the elapsed time during which the plate 1 contacts the heating roller 3 and the surface (surface of the surface layer 1*b*) of the plate 1 be in a softened state by the surface temperature T1*b* increasing to the transition point temperature Tm or above.

FIG. 3B shows a state where the surface of the plate 1 which is softened is pressed against the surface of the mold 2 by the first pressing unit 4, and the lower graph shows the transition of the surface temperature T1*b* of the plate 1 while the plate 1 being pressed at the first pressing unit 4. The horizontal axis is the pressing elapsed time T2 during which the plate is pressed at the first pressing unit 4 and this corresponds to the time for the plate 1 to pass through the second region.

The surface of the plate 1 is pressed against the mold 2 by the first pressing unit 4 while in a softened state. Therefore, the surface of the plate 1 is deformed copying the concave-convex pattern of the mold 2. Further, the temperature T1*b* of the surface layer 1*b* is reduced to the transition point temperature Tm or below before the plate 1 is separated from the mold 2 and the concave-convex pattern which is formed on the surface of the plate 1 is sufficiently hardened.

FIG. 3C shows a state where the plate 1 is separated from the mold 2, and the concave-convex pattern which is printed copying the concave-convex pattern of the mold 2 is formed on the surface of the plate 1.

Next, the second procedure by which the concave-convex pattern is selectively erased by heating the surface layer 1*b* by applying stimulus from outside according to an image signal and a plate image Ip constituted of convex-concave regions Ar and smooth regions Af is formed will be described hereinafter based on FIG. 4.

Figure 4A:
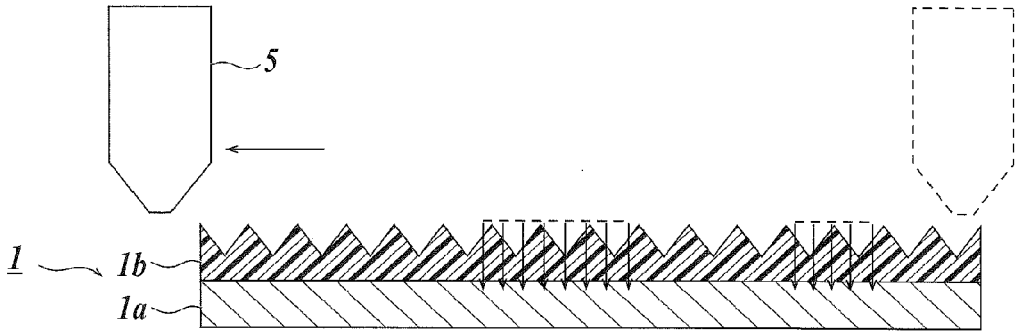
FIGS. 4A to 4C are schematic cross sectional views showing a process of forming a plate image Ip which is constituted of concave-convex regions Ar and smooth regions Af on the surface of the plate 1 according to the present invention.
Figure 4B:
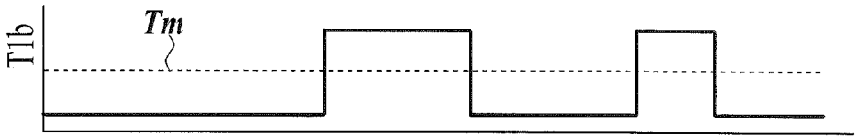
Figure 4C:
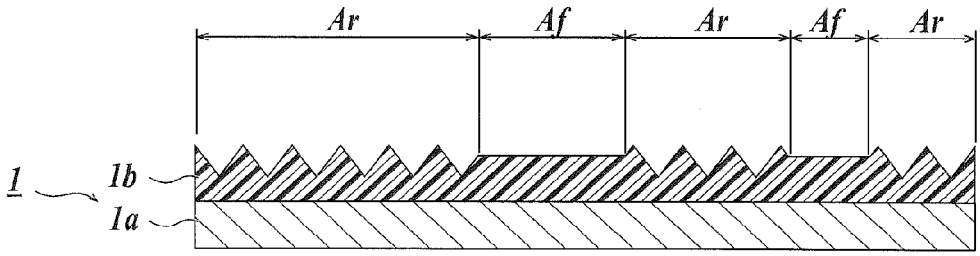

FIGS. 4A to 4C are schematic cross sectional views showing the procedure for forming the plate image Ip constituted of convex-concave regions Ar and smooth regions Af on the surface of the plate 1 by the thermal head 5 as a plate image forming unit.

FIG. 4A shows the heat transfer in the plate 1 corresponding to the heating operation of the thermal head 5. The areas indicated by dashed lines are the heating regions and the other parts are the non-heating regions. The arrow in the drawing indicates the direction of the heat transfer.

FIG. 4B shows the pre-file of the temperature T1*b* in the surface layer 1*b* of the plate 1 which is heated by the heating of the thermal head 5. The vertical axis corresponds to the temperature T1*b* of the surface layer 1*b* and the horizontal axis corresponds to the position of the plate 1 with respect to the rotating direction. The dashed line is the transition point temperature Tm of the surface layer 1*b*. As shown in the diagram, the temperature T1*b* of the surface layer 1*b* exceeds the transition point temperature Tm in the heating regions.

FIG. 4C shows the surface condition of the plate 1 which is formed by the heating operation of the thermal head 5. The horizontal axis corresponds to the position of the plate 1 with respect to the rotating direction.

In the heating regions, the surface layer 1*b* is heated to the transition point temperature Tm or above and is softened, and the smooth regions Af are formed by the surface concave-convex pattern being erased and smoothed out. On the other hand, in the non-heating portions, there is no change in temperature of the surface layer 1*b* and the concave-convex pattern is maintained to form the convex-concave regions Ar.

As described above, a plate image Ip constituted of smooth regions Af and convex-concave regions Ar is formed on the surface of the plate 1 corresponding to the heating/non-heating of FIG. 4A.

Next, the third procedure by which an image is to be formed on a paper S by forming an ink image Ik on the plate 1 by applying ink K to the plate image Ip and further transferring the ink image Ik to the paper S as a recording medium will be described based on FIGS. 5A to 5C.

Figure 5A:
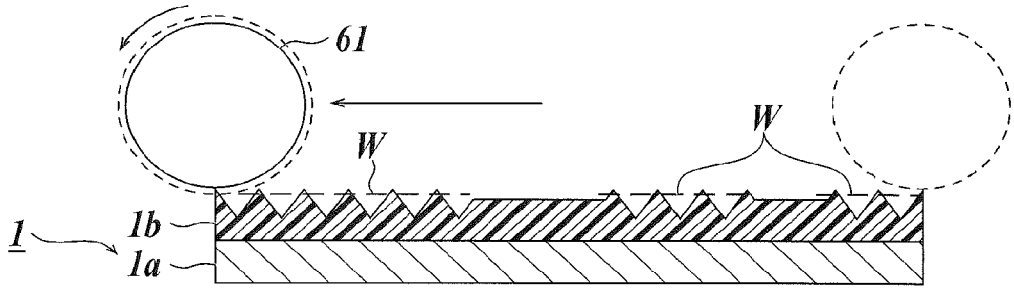
FIGS. 5A to 5C are schematic cross sectional views showing a process of forming an image on a paper S by forming an ink image Ik on the plate 1 and further transferring the ink image Ik on the paper S.

FIG. 5A shows a state where dampening water W is selectively applied only to the concave-convex regions Ar of the plate image Ip by the dampening water supply roller 61.

Here, the dampening water supply roller 61 which is wetted with dampening water W is moved so as to contact and rotate from the position shown in dashed line on the right side to the position shown in solid line on the left side along the surface of the plate 1. In the concave-convex regions Ar where water is easily retained, the dampening water is applied and in the smooth regions Af which is hydrophobic, the dampening water W is repelled.

Figure 5B:
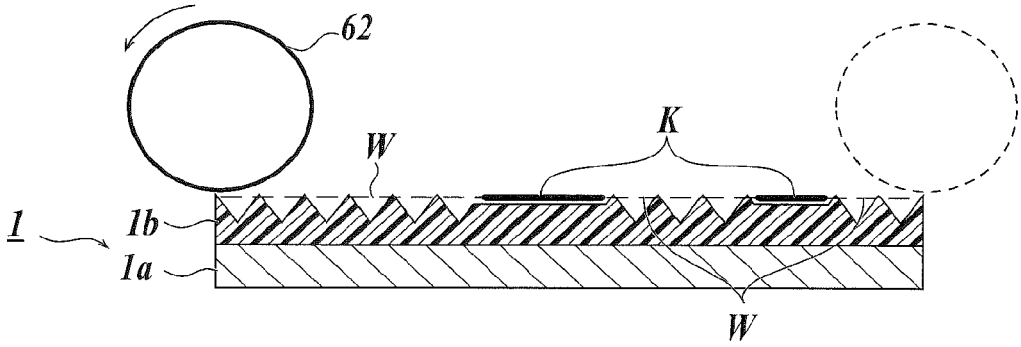

FIG. 5B shows a state where an ink image Ik is formed on the plate 1 by the ink supply roller 62.

Ink K is applied to the ink supply roller 62 and the ink supply roller 62 rotates and moves by contacting the surface of the plate 1 to supply ink K to the plate 1. At the smooth regions Af, ink K is applied. However, ink K is repelled at the concave-convex regions Ar where dampening water W is applied by the dampening water supply roller 61 and ink K is not to be applied to the concave-convex regions Ar. As a result, an ink image Ik is to be formed on the plate 1 corresponding to the smooth regions Af as shown in the drawing.

Figure 5C:
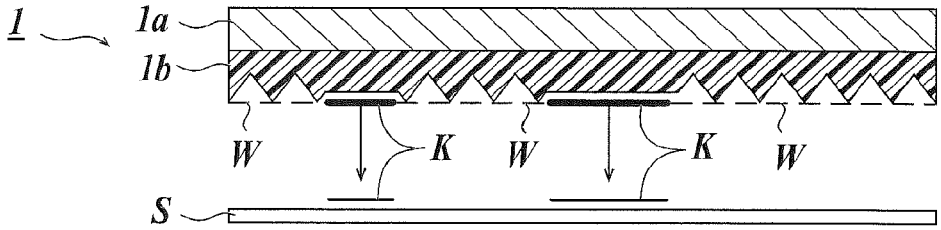

FIG. 5C shows the procedure by which the ink image Ik formed on the plate 1 is to be transferred on to the paper S. Here, the blanket roller 63 is formed with a material having a good releasability, such as nitrile rubber (NBR) or the like, comparing to the paper S, and an optimum amount of ink K is transferred from the ink image Ik on the plate 1 and an ink image Ik is to be formed on the blanket roller 63. Thereafter, the ink image Ik on the blanket roller 63 is to be transferred on to the paper S. On the other hand, the dampening water W on the plate 1 is not transferred.

As described above, the image forming method of the present invention can form a new plate image Ip on the plate 1 by erasing the old plate image Ip and can form an image on the paper S by using the plate 1 on which the new plate image Ip is formed. Therefore, the image forming method of the present invention is excellent in high-speed performance by which images can be processed on a plurality of papers stably and continuously and the plate is not wasted and can be used for variable printing.

[Material of Plate 1]

Material for the surface layer 1*b* and the belt-like support 1*a* of the plate 1 will be described hereinafter.

<Material of Surface Layer 1*b*>

It is preferred that the material of the surface layer 1*b* crystallizes at a temperature of below melting point as the transition point temperature Tm and fluidizes at a temperature of melting point or above. That is, it is preferred that the surface layer 1*b* is made of a side-chain crystalline polymer which reversibly crystallizes and fluidizes according to the temperature change. In such way, at a temperature below melting point, a fine surface pattern as the plate 1 can be maintained stably because the side-chain crystalline polymer is crystallized. Further, at a temperature of melting point or above, the surface layer 1*b* can be deformed easily copying the concave-convex pattern of the mold 2 as a mold because the side-chain crystalline polymer is fluidized.

It is preferred that the thickness of the surface layer 1*b* is several times the depth (distance from bottom to peak) of the concave-convex pattern of the mold 2.

In the present invention, melting point means the temperature where the specified part of the polymer which was at first arranged in order be in a disordered condition and is a value obtained by measuring with a differential scanning calorimetry (DSC) under a measuring condition of 10° C./minute. In the present invention, the melting point of the side-chain crystalline polymer is 50° C. or above, preferably, 50 to 70° C. In such way, workability is improved because the side-chain crystalline polymer is crystallized in room temperature.

As for the composition of the side-chain crystalline polymer, a polymer which can be obtained by polymerizing 30 to 90 mass of (meta)acrylate including straight-chain alkyl of carbon number 16 or more, preferably, carbon number 16 to 22, 0 to 70 mass of acrylic acid ester or ester of methacrylic acid including alkyl of carbon number 1 to 6 and 1 to 10 mass of polor monomer, or the like, is suggested.

As for the (meta)acrylate in which the straight-chain alkyl of carbon number 16 or more is the side-chain, (meta)acrylate including linear alkyl of carbon number 16 to 20 such as cetylic(meta)acrylate, stearyl(meta)acrylate, eicosyl(meta) acrylate, behenyl(meta)acrylate or the like are suggested. As for the (meta)acrylate including alkyl of carbon number 1 to 6, for example, methyl(meta)acrylate, ethyl(meta)acrylate, butyl(meta)acrylate, hexyl(meta)acrylate and the like are suggested. As for the polar monomer, for example, ethylene undersaturated monomer including carboxyl such as acrylic acid, methacrylic acid, crotonic acid, itaconic acid, maleic acid, fumaric acid or the like, ethylene undersaturated monomer including hydroxyl such as 2-hydroxyethyl(meta)acrylate, 2-hydroxypropyl(meta)acrylate, 2-hydroxyhexyl(meta) acrylate or the like are suggested.

The hardness of the surface layer 1*b* of the plate 1 changes precipitously at the transition point temperature Tm. Further, the surface layer 1*b* of the plate 1 is made of a temperature sensitive material in which the hardness changes reversibly according to the temperature change. For example, a material which switches to softened state from hardened state when temperature is increased by about 5° C. is to be used.

Here, the cool-off intelimer manufactured by NITTA CORPORATION having thickness of 40 μm and wherein the transition point temperature Tm is 50° C. is used.

The cool-off intelimer is in crystallized state when temperature is below the transition point temperature Tm and changes to non-crystallized state when temperature is the transition point temperature Tm or above. Therefore, the cool-off intelimer is in hardened state when crystallized and is in softened state when not crystallized.

The transition point temperature Tm can be set in a range of 30 to 50° C. in the cool-off intelimer and the switching between crystallized state and non-crystallized state occurs precipitously within the range of about 5° C. Therefore, the fine structure can be copied and maintained on the surface of the cool-off intelimer by carrying out heating and cooling. This change in state can be reversibly repeated every time the temperature change is carried out. When considering that the cool-off intelimer is to be used as the plate 1, it is preferred that the transition point temperature Tm is set to 40° C. or above.

It is preferred that the thickness of the cool-off intelimer is in the range of 10 μm to 80 μm, specifically, 40 μm when considering the fine structure is to be transferred and be erased.

<Material of Belt-Like Support>

Polyethylene terephthalate having thickness of 100 μm is used for the resin support 1*a*. However, a resin other than polyethylene terephthalate can be used as long as the resin has resistivity to heating temperature of the heating roller 3. For example, films of synthetic resin such as polyethylene, polypropylene, polyester, polyamide, polyimide, polycarbonate, ethylene-vinyl acetate copolymer, ethylene-ethyl acrylate copolymer, ethylene polyprolylene copolymer, polyvinyl chloride and the like are suggested. Thickness thereof is usually about 100 to 500 μm. The surface of the supporter la can be treated by corona discharge treatment, plasma treatment, blasting treatment, chemical etching treatment, priming treatment or the like in order to improve adhesiveness to the surface layer 1*b*.

[Concave-Convex Pattern of Mold 2]

The mold 2 is formed with the processing method similar as the mold which is used for nanoimprint, for example, and the mold 2 is a roller having a structure as described below on it surface.

Figure 6A:
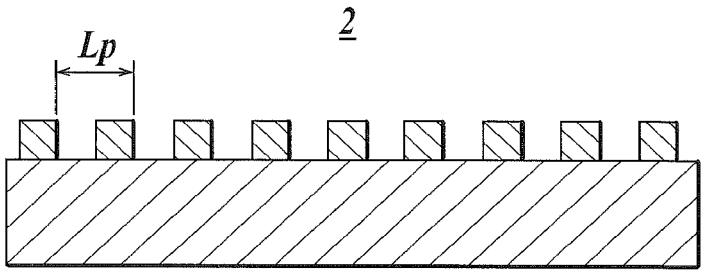
FIGS. 6A to 6B are enlarged views showing a mold 2 in which a concave-convex pattern of pillar structure is formed on the surface thereof.
Figure 6B:
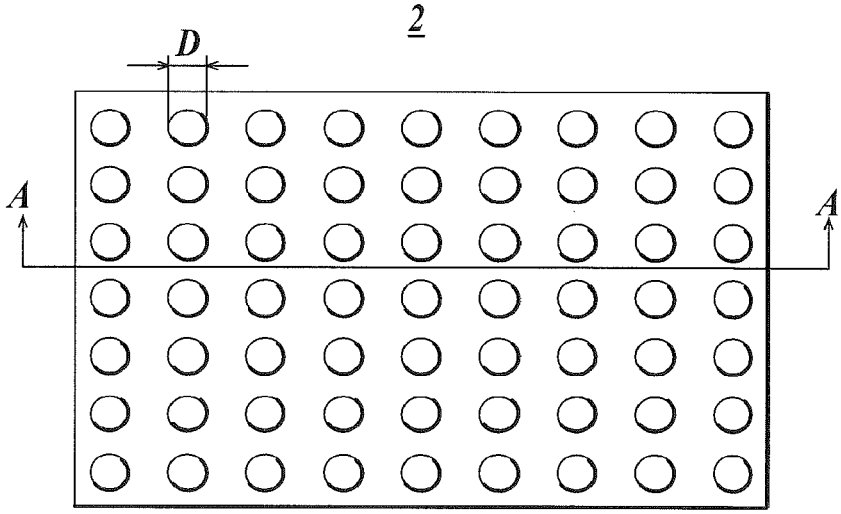
Figure 7:
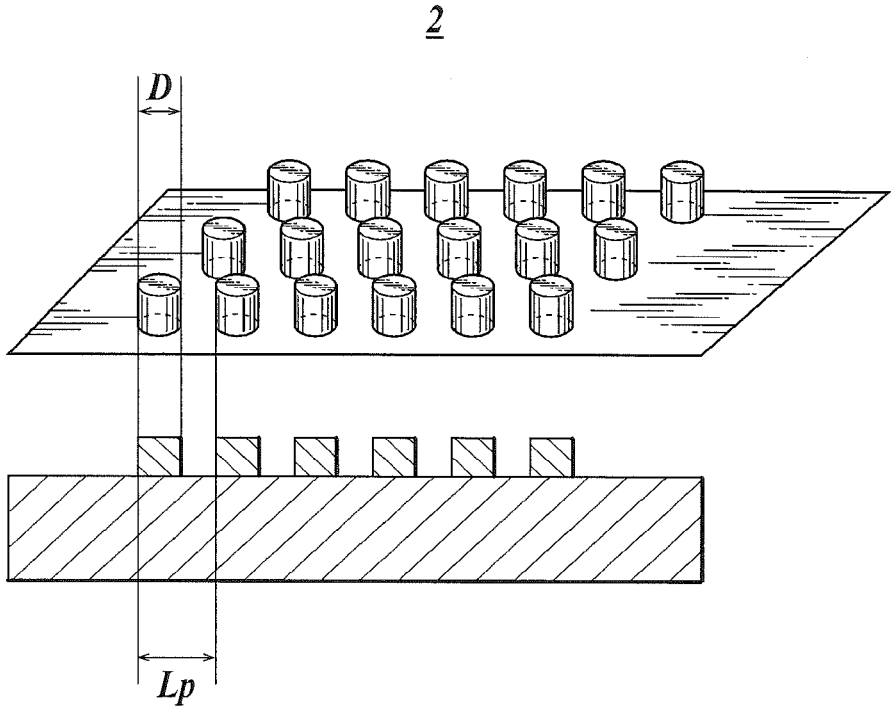
FIG. 7 is an enlarged view showing the mold 2 in which a concave-convex pattern of pillar structure is formed on the surface thereof.

FIG. 6A is a cross-sectional view when cut along the line A-A shown in FIG. 6B and is an enlarged cross-sectional view showing the mold 2 on which a concave-convex pattern of pillar structure is formed on the surface thereof. FIG. 6B is an enlarged top view showing the surface of the mold 2. Further, FIG. 7 is an enlarged schematic view and an enlarged cross sectional view showing the surface of the mold 2. The pillar structure as shown in the drawing is constituted of a plurality of convexes which are independent from each other, and the convexes are arranged in orderly fashion with aspect ratio of about 0.3 to 2.

Figure 8A:
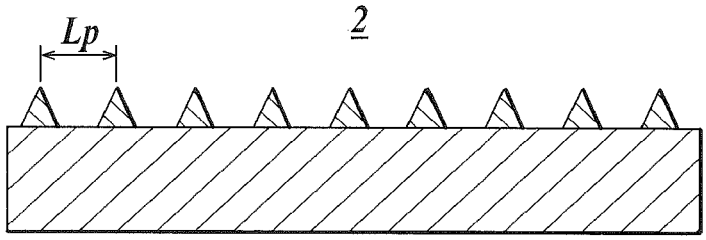
FIGS. 8A and 8B are enlarged views showing a mold 2 in which a concave-convex pattern of conical structure is formed on the surface thereof.
Figure 8B:
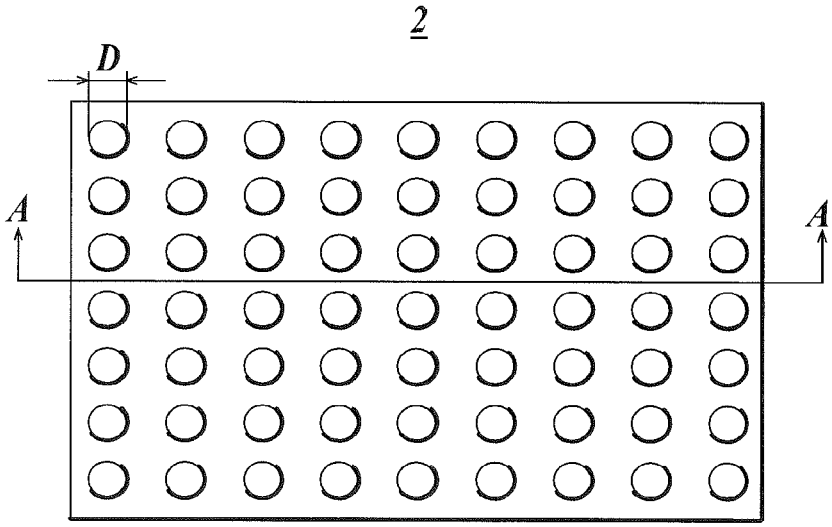
Figure 9:
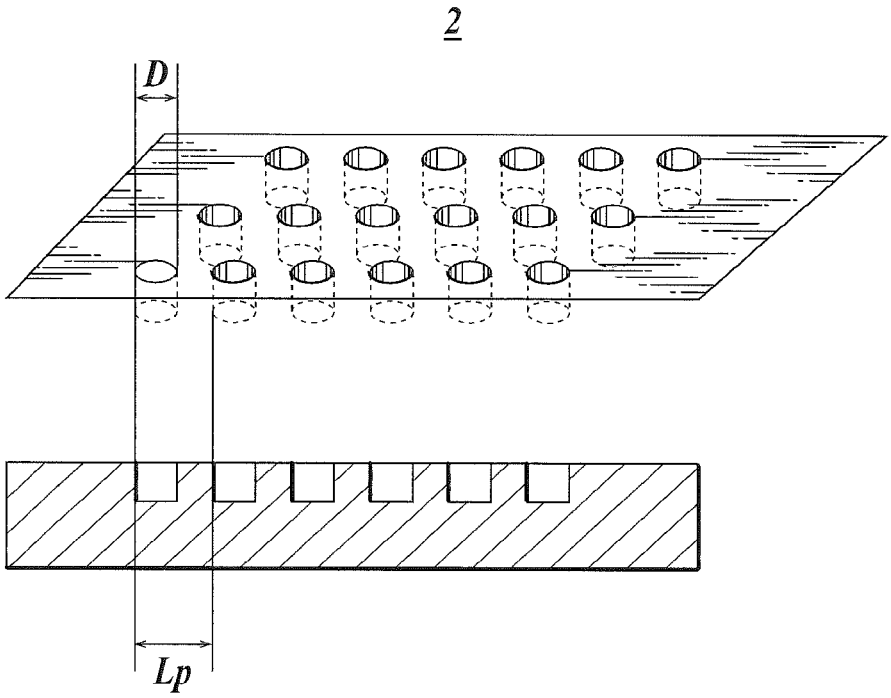
FIG. 9 is an enlarged view showing a mold 2 in which a concave-convex pattern of hole structure is formed on the surface thereof.

The concave-convex pattern of the mold 2 may be a conical pattern in which cones are arranged in orderly fashion as shown FIG. 8, hole structure which are arranged on orderly fashion as shown in FIG. 9 or convex-concave pattern arranged in irregular fashion (not shown in the drawing) as long as water can be retained on the surface of the plate 1 by the concave-convex pattern of the mold 2 being copied on the surface of the plate 1. However, the pillar structure is preferred in particular. This is because, when the concave-convex pattern to be formed on the plate 1 by the mold 2 is of a plurality of concaves which are independent from each other, dampening water supplied to the plate 1 forms a water film on the concave-convex region by entering into the concaves in the concave-convex region of the plate 1 and the retention of dampening water be greater.

Moreover, it is preferred that the diameter D of the convexes of the concave-convex pattern of the mold 2 is greater than 100 nm and 20 μm or smaller. Further, it is preferred that the interval Lp between each convex of the mold 2 is 100 nm or greater and 10 μm or smaller. Furthermore, it is preferred that D/Lp is ½ or greater.

When the fine concave-convex pattern as described above is to be formed on a hydrophobic (lipophilic) resin in which the pure water contact angle is smaller than 90°, the surface can be changed to a surface which can easily retain water, that is, a surface which is suited for offset printing.

Here, a mold which is made by applying Si thin film layer on an aluminum roller and by carrying out fine processing by etching or the like is used. The fine structure is constituted of a plurality of convexes of Lp: 2 μm and D: 2 μm which are independent from each other, and the plurality of convexes are arranged on the aluminum roller in orderly fashion. By using such mold, the fine structure in which a plurality of convexes which are independent from each other are arranged in orderly fashion can be formed on the cool-off intelimer. By supplying dampening water to the concaves which are arranges in orderly fashion while applying pressure with the dampening water supply roller or the like, the dampening water enters the fine convexes and the dampening water can be retained on the fine structure. In such way, the portion on the cool-off intelimer where the fine structure is formed be in a state where water is easily retained comparing to the flat portion where the fine structure is not formed. Because the portion where the fine structure is formed retains dampening water, ink adheres to the flat portion when inking is carried out but ink does not adhere to the portion where the fine structure which retains dampening water is formed.

Other Embodiment of the Present Invention

Figure 10:
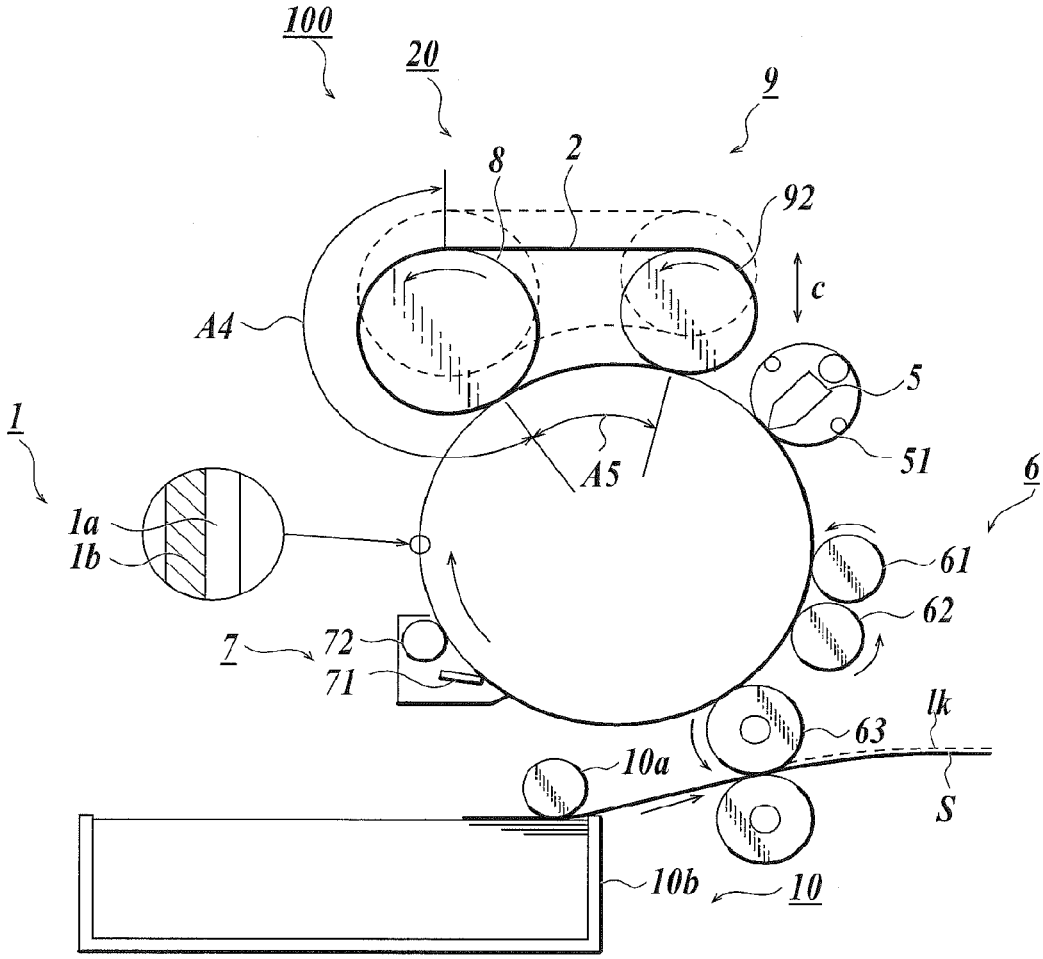
FIG. 10 is an outline cross sectional view showing the second embodiment of the image forming apparatus 100 according to the present invention.

FIG. 10 is an outline cross sectional view showing the second embodiment of the image forming apparatus 100 according to the present invention.

The second embodiment differs from the first embodiment in that the plate 1 is formed in a drum shape and the mold 2 is formed in a belt-like shape. Further, in relation to the differences in the plate 1 and the mold 2, the structure of the concave-convex pattern forming unit 20 is also different from that of the first embodiment. However, other structures are basically the same as the first embodiment. The image forming method is same as that in the first embodiment.

The plate 1 includes a support 1*a* formed of a metal drum such as aluminum or the like and a surface layer 1*b* formed on the support 1*a*, and the surface layer 1*b* is formed of a resin or the like which softens at the temperature of transition point temperature Tm or above and hardens at the temperature of below transition point temperature Tm. The mold 2 is formed in a belt-like shape and a concave-convex pattern shown in FIGS. 6 to 9 is formed on the surface thereof, and is called a belt-like mold 2.

The concave-convex pattern forming unit 20 includes the belt-like mold 2, a mold heating roller 8 as the second heating unit and the second pressing unit 9.

The belt-like mold 2 is formed of a heat resistance resin or nickel and is supported so as to rotate by the mold heating roller 8 as the second heating unit and the supporting roller 92.

The mold 2 can be displaced as shown in the arrow c with respect to the drum shaped plate 1 being integral with the supporting roller 92 by the biasing unit (not shown in the diagram). The solid line shows a state where the mold 2 is pressed against the plate 1 by the disposition mechanism (not shown in the drawing) and the dashed line shows a state where the mold 2 is separated from the plate 1.

The mold heating roller 8 is an aluminum roller in which the surface thereof is covered with a silicon rubber and a heater is embedded inside thereof. The mold heating roller 8 is heated to a predetermined temperature which exceeds the transition point temperature Tm of the surface layer 1*b* by the heater turning on controller (not shown in the diagram), and contacts the belt-like mold 2 at the fourth region indicated by A4 as shown in the drawing. The mold 2 is heated to a temperature of transition point temperature Tm or above by heat transfer from the fourth region A4. Here, the mold 2 is heated by heat transfer. However, the way of heating is not limited to this, and the heating can be carried out by irradiating radiation energy to the mold 2 from outside as in halogen heater or the like.

The second pressing unit 9 makes the belt-like mold 2 which is heated to the temperature of transition point temperature Tm or above by the mold heating roller 8 as the second heating unit against the drum shaped plate 1, and the second pressing unit 9 is constituted of the mold heating roller 8 which also functions as the second heating unit, the supporting roller 92 and the like.

The second pressing unit 9 makes the mold heating roller 8 and the supporting roller 92 cooperate with each other, and the fifth region where the belt-like mold 2 is pressed against the plate 1 and which occupies an area on the downstream side in the rotation direction of the fourth region A4.

The surface of the plate 1 softens by being heated to a temperature of transition point temperature Tm or above by heat transfer from the belt-like mold 2 at the extreme upstream end of the fifth region A5. Further, the surface of the plate 1 is deformed copying the concave-convex pattern of the mold 2 by receiving a great pressure from the mold heating roller 8 and is cooled to a temperature of below transition point temperature Tm by heat transfer to the support 1*a* while moving through the fifth region A5. Therefore, the surface of the plate 1 is hardened while maintaining the concave-convex pattern of the mold 2.

As described above, the concave-convex pattern forming unit 20 deforms and hardens the surface of the plate 1 copying the concave-convex pattern of the mold 2 in cooperation with the mold heating roller (the second heating unit) 8 and the second pressing unit 9, and the concave-convex pattern of the mold 2 can be copied on the surface of the plate 1 stably and continuously.

The thermal head 5 as a plate image forming unit is disposed on the downstream side of the concave-convex pattern forming unit 20, and a plate image Ip which is constituted of the concave-convex regions Ar having the concave-convex pattern and the smooth regions Af where the concave-convex pattern is erased according to the image signal is formed on the surface of the plate 1 by the thermal head 5.

The print unit 6 is disposed on the downstream side of the thermal head 5, and the print unit 6 includes the dampening eater supply roller 61, the ink supply roller 62 and the blanket roller 63.

The dampening water supply roller 61 contacts the plate 1 which is disposed on the uppermost part in the rotating direction of the plate 1 and selectively applies dampening water W to the concave-convex regions of the plate 1 by rotating as shown by the arrow.

The ink supply roller 62 contacts the drum-shaped plate 1 which is disposed on the downstream side of the dampening water supply roller 61 and forms an ink image Ik on the plate 1 by selectively applying ink K to the smooth regions of the plate 1.

The blanket roller 63 contacts the drum-shaped plate 1 which is disposed on the downstream side of the ink supply roller 62 and forms an ink image on a paper S transferring the ink image Ik on the plate 1 on to the blanket roller 63 itself and then by re-transferring the ink image Ik on to the paper S.

The cleaning device 7 is disposed on the downstream side of the print unit 6 and removes the residual ink image Ik and dampening water W on the plate 1.

As described above, the image forming apparatus 100 of the second embodiment according to the present invention can erase the old plate image Ip and form a new plate image Ip on the plate 1 and further, can form an image on the paper S by using the plate 1 on which the new plate image Ip is formed. Therefore, the image forming apparatus 100 of the second embodiment according the present invention has an excellent high-speed performance in which an image can be continuously processed on a plurality of papers stably and can be used for the variable printing.

In the above described embodiment of the present invention, a resin in which the pure water contact angle is smaller than 90° is used for the surface layer 1*b* of the plate 1 and an ink image Ik can be formed on the plate 1 by forming a plate image Ip constituted of concave-convex regions Ar and smooth regions Af on the plate 1, selectively applying dampening water W to the concave-convex regions Ar on the plate 1 by the dampening water supply roller 61 and selectively applying ink K to the smooth regions Af on the plate 1 by the ink supply roller 62 below so that the ink K will not be applied to the concave-convex regions Ar on the plate 1.

On the other hand, the scope of the present invention includes the image forming method and image forming apparatus which uses a resin in which the pure water contact angle is greater than 90° for the surface layer 1*b* of the plate 1, and forms a plate image Ip constituted of the concave-convex regions Ar and the smooth regions Af on the plate 1 by forming the concave-convex pattern on the surface of the plate 1 and erasing the concave-convex pattern corresponding to the image signal, forms a plate image Ip constituted of the concave-convex regions Ar and the smooth regions Af on the plate 1 by forming the smooth regions Af by erasing the concave-convex patter corresponding to the image signal after changing the surface to a low surface energy by forming the concave-convex patter on the surface of the plate 1 so that ink K does not adhere to the surface of the plate 1, and forms an ink image Ik on the plate 1 by applying ink K only to the smooth regions Af on the plate directly by the ink supply roller 62 not using the dampening water supply roller 61.

Here, the transition point temperature Tm which stipulates the material to be used for the surface layer 1*b* (surface) of the plate 1 of the present invention can be replaced with the melting point at which the material transfers to liquid state from solid state with respect a temperature, the glass transition temperature at which glass transfers into glass state from a crystal state or the softening point at which the material is changed to a viscose liquid from elastic state. Melting point, glass transition temperature and softening point are relevant for the transition point temperature Tm of the present invention.

The present invention is not limited to the embodiments described above, and for example, an image forming method and an image forming system in which printing is executed after the procedure of forming the plate is carried out first, the procedure of forming the plate and the printing procedure being carried out separately, are also within scope of the present invention.

Example

Hereinafter, the present invention will be described in detail by showing an example. However, the present invention is not limited to the example. In the following example, images formed on papers S by the image forming apparatus 100 according to the above described embodiment were evaluated by changing the diameter D of the convexes and the interval Lp between the convexes of the concave-convex pattern in a case where the concave-convex pattern of the mold 2 is pillar structure.

In the examples, the diameter D of the convexes of the concave-convex pattern of the mold 2 is changed so as to be 100 nm, 500 nm, 1 μm, 5 μm, 10 μm, 20 μm and 30 μm and the interval Lp between the convexes of the concave-convex pattern of the mold 2 is changed to as to be 100 nm, 500 nm, 1 μm, 5 μm, 10 μm, 20 μm and 30 μm, and images formed on papers S were evaluated. The minimum value 100 nm of the diameter D of the convexes of the mold 2 and the interval Lp between the convexes of the mold 2 is the lower limit with respect to a machine for manufacturing the mold 2, and the mold 2 with smaller values for the diameter D and the interval Lp cannot be manufactured. Evaluation of images was carried out by visually evaluating whether a so-called blurring where ink is adhered to the non-image portions of the paper S occurred or not in the images formed on the paper S. The results are shown in table 1.

The condition for image forming in the examples is as follows. Density of IPA (Isopropyl Alcohol) which is dampening water: 5 wt %, supplying amount of dampening water: 1 ml/m$^2$, among of ink on the surface of ink supply roller: 20 g/m2, pressure of each roller: 40 N/cm$^2$ and driving speed of the apparatus: 200 mm/s.

Moreover, in table 1, ○ is indicated when blurring does not occur in the image formed on the paper S, "Δ" is indicated when blurring occurs in the image formed on the paper S but is not distinct and "X" is indicated when blurring is obviously shown in the image formed on the paper S.

TABLE 1

| | | Lp | | | | | | |
|---|---|---|---|---|---|---|---|---|
| | | 100 nm | 500 nm | 1 μm | 5 μm | 10 μm | 20 μm | 30 μm |
| D | 100 nm | — | — | — | — | — | — | — |
| | 500 nm | ○ | ○ | Δ | X | X | X | X |
| | 1 μm | ○ | ○ | ○ | X | X | X | X |
| | 5 μm | ○ | ○ | ○ | ○ | Δ | X | X |
| | 10 μm | Δ | Δ | ○ | ○ | ○ | Δ | X |
| | 20 μm | Δ | Δ | Δ | Δ | Δ | Δ | Δ |
| | 30 μm | X | X | X | X | X | X | X |

As shown in table 1, when the diameter D of each of the convexes of the mold is greater than 100 nm and 20 μm or smaller, quality of the images formed on the papers S were good. Similarly, when the interval Lp between the convexes of the mold 2 is 100 nm or greater and 10 μm or smaller, quality of the images formed on the papers S were also good. Further, it is clear from the result shown in table 1 that smaller the diameter of each of the convexes of the mold 2, better the quality of the images formed on the papers S. Further, when the diameter of each of the convexes of the mold 2 is greater than 100 nm which is the limit value with respect to manufacturing of the mold 2, quality of the images formed on the papers S is good.

The entire disclosures of Japanese Patent Application No. 2010-185672 filed on Aug. 21, 2010 and Japanese Patent Application No. 2011-111944 filed on May 19, 2011 including descriptions, claims, drawings, and abstracts are incorporated herein by reference in their entirety.

What is claimed is:

1. An image forming method, comprising:

forming a concave-convex pattern on a surface of a plate by pressing the plate and a mold having the convex-concave pattern on a surface thereof against each other, the plate having the surface made of a material in which a hardness changes reversibly at a transition point temperature;

forming a plate image constituted of a concave-convex region having the concave-convex pattern and a smooth region in which the concave-convex pattern is erased on the plate by erasing the concave-convex pattern by selectively heating the surface of the plate to the transition point temperature or above corresponding to an image signal; and forming an image on a recording medium by forming an ink image on the plate by applying an ink on the plate image and by transferring the ink image on to the recording medium.

2. The image forming method of claim 1, wherein the material is a resin which softens at the transition point temperature or above and hardens at below the transition point temperature.

3. The image forming method of claim 1, wherein the material is hydrophobic or lipophilic and water is retainable by the concave-convex patter being forming on the surface.

4. An image forming apparatus, comprising:

a plate which is supported so as to rotate and which has a surface formed of a material in which a hardness changes reversibly at a transition point temperature;

a mold having a concave-convex pattern on a surface thereof;

a concave-convex pattern forming unit which forms a concave-convex patter on the surface of the plate by copying the concave-convex pattern on the surface of the plate by pressing the surface of the mold and the surface of the plate against each other;

a plate image forming unit which forms a plate image constituted of a concave-convex region having the concave-convex pattern and a smooth region in which the concave-convex pattern in erased by erasing the concave-convex pattern by selectively heating the surface of the plate to the transition point temperature or above corresponding to an image signal, the plate image forming unit being disposed on a downstream side of the convex-concave pattern forming unit in a rotating direction of the plate; and a print unit which prints an image on a recording medium by forming an ink image on the plate by applying an ink to the plate image formed by the plate image forming unit and by transferring the ink image on the plate on to the recording medium.

5. The image forming apparatus of claim 4, wherein the material softens at the transition point temperature or above and hardens at below the transition point temperature.

6. The image forming apparatus of claim 4, wherein the concave-convex pattern forming unit comprises a first heating unit which heats the plate to the transition point temperature or above and a first pressing unit which presses the plate which is heated by the first heating unit against the mold.

7. The image forming apparatus of claim 6, wherein the first pressing unit lowers a temperature of the surface of the plate to below the transition point temperature while the plate is pressed against the mold.

8. The image forming apparatus of claim 4, wherein the concave-convex forming unit comprises a second heating unit which heats the mold to the transition point temperature or above and a second pressing unit which presses the plate against the mold which is heated by the second heating unit; and the second pressing unit increases a temperature of the surface of the plate to the transition point temperature or above while the plate is pressed against the mold.

9. The image forming apparatus of claim 8, wherein the second pressing unit lowers the temperature of the surface of the plate to below the transition point temperature from the transition point temperature or above while the plate is pressed against the mold.

10. The image forming apparatus of claim 4, wherein the material is hydrophobic or lipophilic and water is retainable by the concave-convex pattern being formed on the surface of the plate.

11. The image forming apparatus of claim 10, wherein the print unit comprises:

a dampening water supply unit which selectively adheres dampening water to a part on the surface of the plate where water is retainable by supplying the dampening water to the surface of the plate; and an ink supply unit which adheres an ink to a part on the surface of the plate where the dampening water is not adhered by the dampening water supply unit by supplying the ink to the surface of the plate, the ink supply unit being disposed on a downstream side of the dampening water supply unit in a rotating direction of the plate.

12. The image forming apparatus of claim 4, wherein the concave-convex pattern of the mold is formed of a plurality of convexes which are independent from each other.

13. The image forming apparatus of claim 12, wherein the plurality of convexes of the mold are arranged in an orderly fashion on the surface of the mold.

14. The image forming apparatus of claim 12, wherein a diameter of the convexes is greater than 100 nm and 20 μm or smaller.

15. The image forming apparatus of claim 12, wherein an interval between the convexes is 100 nm or greater and 10 μm or less.

16. The image forming apparatus of claim 4, wherein the plate image forming unit heats the surface of the plate via a heat resistance film.

17. The image forming apparatus of claim 16, wherein a thickness of the heat resistance film is 25 μm or less.

* * * * *